US011602944B2

(12) United States Patent
Kanno et al.

(10) Patent No.: US 11,602,944 B2
(45) Date of Patent: Mar. 14, 2023

(54) FOREIGN MATERIAL REMOVING DEVICE AND PRINTING APPARATUS

(71) Applicant: SEIKO EPSON CORPORATION, Tokyo (JP)

(72) Inventors: Yusuke Kanno, Shiojiri (JP); Norio Nagata, Matsumoto (JP); Hiroyuki Endo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/451,438

(22) Filed: Oct. 19, 2021

(65) Prior Publication Data

US 2022/0118759 A1 Apr. 21, 2022

(30) Foreign Application Priority Data

Oct. 21, 2020 (JP) ..... JP2020-176449

(51) Int. Cl.
*B41J 29/17* (2006.01)

(52) U.S. Cl.
CPC ..... *B41J 29/17* (2013.01); *B41P 2235/22* (2013.01)

(58) Field of Classification Search
CPC ..... B41J 29/17; B41J 2/165; B41P 2235/22
See application file for complete search history.

(56) References Cited

U.S. PATENT DOCUMENTS 5,556,251 A * 9/1996 Hiroi ..... B41J 13/106 414/790.3
2016/0288539 A1 10/2016 Yanagisawa et al.

FOREIGN PATENT DOCUMENTS

JP 2012131578 A * 7/2012
JP 2014234253 A * 12/2014
JP 2016-193561 A 11/2016

OTHER PUBLICATIONS

Kikuta, MachineTranslationof—JP-2014234253-A, 2014 (Year: 2014).*
Umeno, MachineTranslationof—JP-2012131578-A, 2012 (Year: 2012).*

* cited by examiner

*Primary Examiner* — Scott A Richmond
(74) *Attorney, Agent, or Firm* — Workman Nydegger

(57) ABSTRACT

A cleaning roller to be brought into contact with a medium includes a rotary shaft having a first end portion and a second end portion, and a sticky roller attached to the rotary shaft. A cleaning roller holder includes a first bearing portion configured to restrict a movement range of the first end portion and a second bearing portion configured to restrict a movement range of the second end portion. In a state where the first end portion is disposed at the first bearing portion and the second end portion is disposed at the second bearing portion, the cleaning roller holder positions the cleaning roller in a detachable manner. The center of gravity of the cleaning roller is shifted from the center of the cleaning roller in the longitudinal direction toward the first end portion, and is in a range where the sticky roller exists in the longitudinal direction.

14 Claims, 13 Drawing Sheets

FOREIGN MATERIAL REMOVING DEVICE AND PRINTING APPARATUS

The present application is based on, and claims priority from JP Application Serial Number 2020-176449, filed on Oct. 21, 2020, the disclosure of which is hereby incorporated by reference herein in its entirety.

BACKGROUND

1. Technical Field

The present disclosure relates to a foreign material removing device that includes a cleaning roller and a cleaning roller holder, and a printing apparatus.

2. Related Art

A line inkjet printer has been known as a printing apparatus. The line inkjet printer drives and controls a printing head to perform printing on a front surface of long recording paper, as described in JP-A-2016-193561. When foreign materials such as paper dust are attached on the recording paper, the foreign materials may be also attached on the printing head, which causes the nozzle of the printing head to be clogged. Thus, it can be considered to dispose a foreign material removing device including a cleaning roller upstream of the printing head in a transport direction of the recording paper. The cleaning roller has a front surface having stickiness, and is brought into contact with a front surface of the recording paper to remove the foreign materials from the front surface of the recording paper.

It is preferable that the printing apparatus allows a plurality of types of recording paper having different widths to be switched and be used. Here, there is a possibility that the cleaning roller tilts when the center of the recording paper in the width direction of long recording paper is shifted from the center of the cleaning roller. This may result in a reduction in a performance of removing the foreign materials or occurrence of an unusual noise.

Note that the problem as described above exists not only in a line inkjet printer but also in various types of printing apparatuses such as a serial-type printer and various types of foreign material removing devices.

SUMMARY

A foreign material removing device according to the present disclosure has an aspect that provides a foreign material removing device including a cleaning roller to be brought into contact with a medium and a cleaning roller holder, in which the cleaning roller includes a rotary shaft including a first end portion and a second end portion disposed on an opposite side from the first end portion, and includes a sticky roller attached to the rotary shaft and having a front surface having stickiness, the cleaning roller holder includes a first bearing portion configured to restrict a movement range of the disposed first end portion, and a second bearing portion configured to restrict a movement range of the disposed second end portion, in a state where the first end portion is disposed at the first bearing portion and the second end portion is disposed at the second bearing portion, the cleaning roller holder positions the cleaning roller in a detachable manner, and a center of gravity of the cleaning roller is shifted from a center of the cleaning roller in a longitudinal direction toward the first end portion, and is in a range where the sticky roller exists in the longitudinal direction.

In addition, a printing apparatus according to the present disclosure has an aspect in which the printing apparatus includes a transport unit configured to transport a recording medium in a transport direction, a guiding portion configured to guide transport, by the transport unit, of the recording medium, a printing head configured to perform printing on the recording medium, and a foreign material removing device disposed upstream of the printing head in the transport direction, the guiding portion includes a first guide configured to guide a one-side edge portion of the recording medium in a width direction of a transport path of the recording medium, and a second guide configured to guide an other-side edge portion of the recording medium, the first guide being configured not to move in the width direction, the second guide being configured to move in the width direction, the printing apparatus is configured to perform printing on a first recording medium and a second recording medium as the recording medium, the second recording medium having a width in the width direction wider than the first recording medium, the first recording medium and the second recording medium are positioned in the width direction with the first guide being a reference, the foreign material removing device includes a cleaning roller to be brought into contact with the recording medium, and includes a cleaning roller holder, the cleaning roller includes a rotary shaft including a first end portion and a second end portion disposed on an opposite side from the first end portion, and includes a sticky roller attached to the rotary shaft and having a front surface having stickiness, the cleaning roller holder includes a first bearing portion configured to restrict a movement range of the disposed first end portion, and a second bearing portion configured to restrict a movement range of the disposed second end portion, in a state where the first end portion is disposed at the first bearing portion and the second end portion is disposed at the second bearing portion, the cleaning roller holder positions the cleaning roller in a detachable manner, and a center of gravity of the cleaning roller exists at a position that overlaps with the first recording medium in the width direction.

DESCRIPTION OF EXEMPLARY EMBODIMENTS

Figure 1:
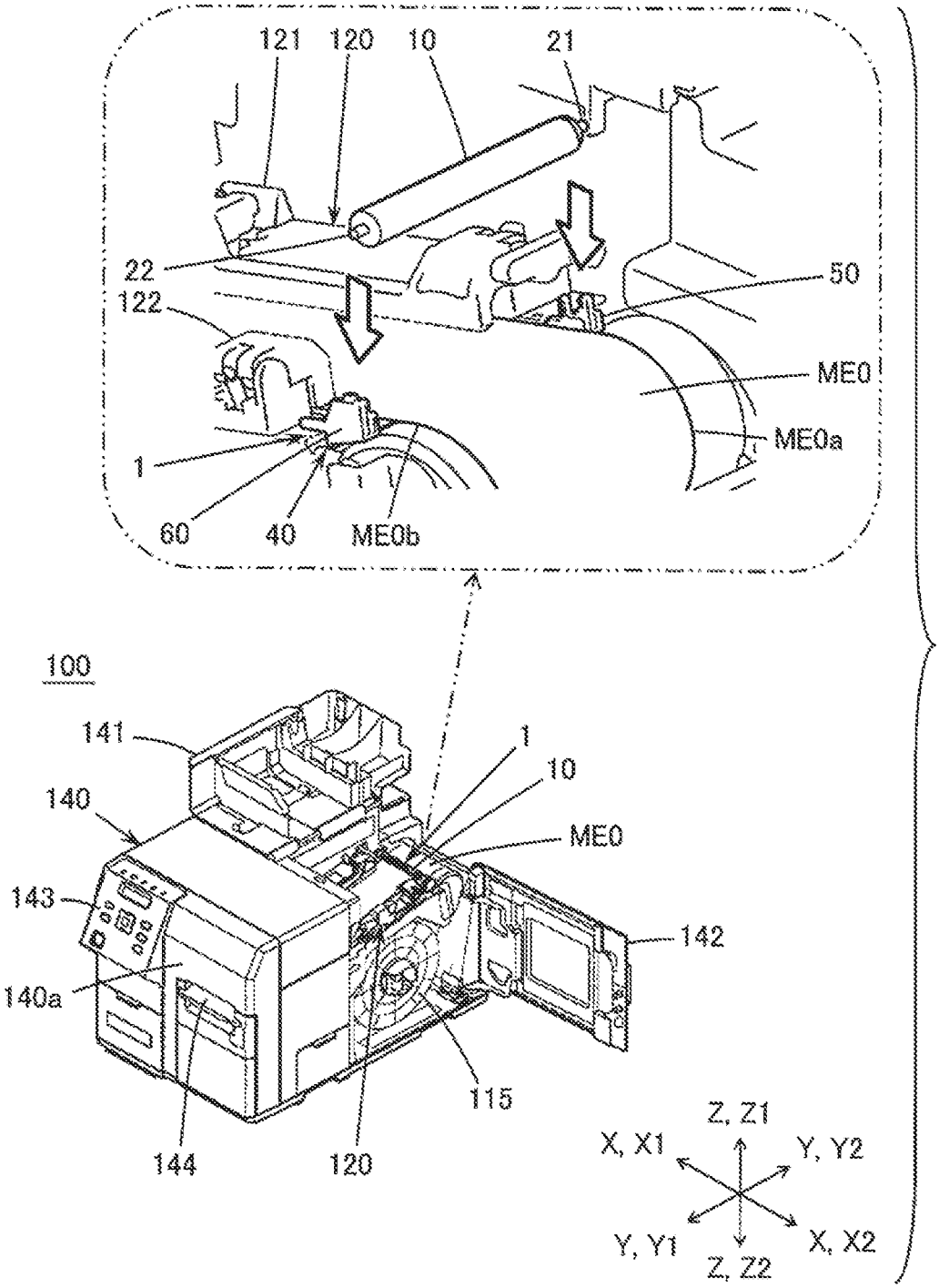
FIG. 1 is a perspective view schematically illustrating an example of a printing apparatus including a foreign material removing device.

Below, embodiments according to the present disclosure will be described. Needless to say, the embodiments described below are given merely as examples of the present disclosure, and all features illustrated in the embodiments are not necessarily essential for a solving means in the present disclosure.

(1) OVERVIEW OF TECHNIQUE INCLUDED IN PRESENT DISCLOSURE

First, the outline of techniques included in the present disclosure will be described with reference to examples illustrated in FIGS. 1 to 13. Note that the drawings in the present application are drawings that schematically illustrate examples. The enlargement ratio in individual directions illustrated in these drawings may differ and the individual drawings may also be contradict. Needless to say, individual elements of the present technique are not limited to specific examples indicated with reference characters. In the "Overview of technique included in present disclosure," items within the parentheses mean additional explanation for the immediately preceding word.

Furthermore, in the present application, the numerical range "Min to Max" means not less than the minimum value Min and not more than the maximum value Max.

First Aspect

A foreign material removing device 1 according to one aspect of the present technique includes a cleaning roller 10 to be brought into contact with a medium (for example, a recording medium ME0), and a cleaning roller holder 40. The cleaning roller 10 includes a rotary shaft 20 including a first end portion 21 and a second end portion 22 disposed on an opposite side from the first end portion 21, and includes a sticky roller 30 attached to the rotary shaft 20 and having a front surface 31 having stickiness. The cleaning roller holder 40 includes a first bearing portion 50 configured to restrict a movement range of the disposed first end portion 21, and a second bearing portion 60 configured to restrict a movement range of the disposed second end portion 22. In a state where the first end portion 21 is disposed at the first bearing portion 50 and the second end portion 22 is disposed at the second bearing portion 60, the cleaning roller holder 40 positions the cleaning roller 10 in a detachable manner. As illustrated, for example, in FIG. 4 as an example, the center of gravity CG1 of the cleaning roller 10 is shifted from a center CE1 of the cleaning roller 10 in a longitudinal direction D1 toward the first end portion 21, and is in a range where the sticky roller 30 exists in the longitudinal direction D1.

Figure 13:
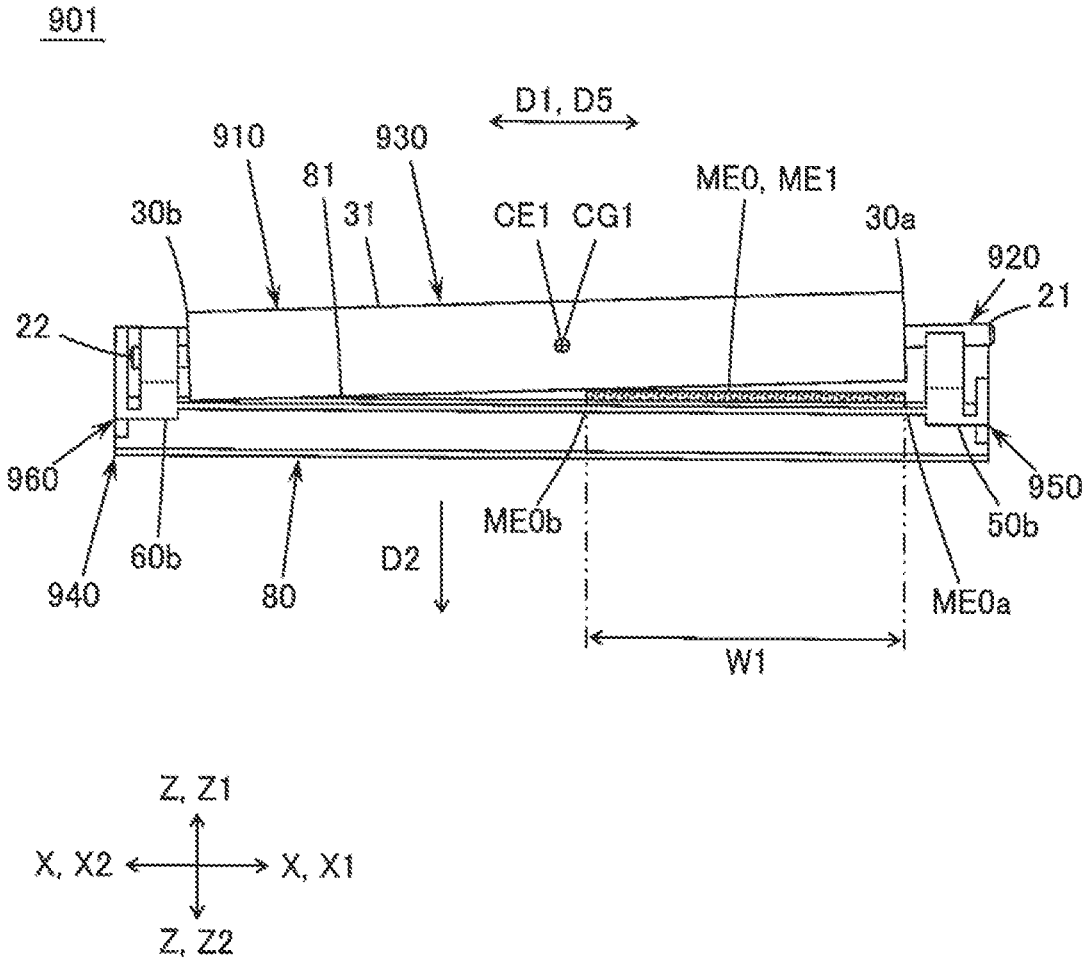
FIG. 13 is a diagram schematically illustrating a foreign material removing device according to a comparative example in which the center of gravity of the cleaning roller is located at the center of the cleaning roller in the longitudinal direction.

There is a case where the center of gravity CG1 of the cleaning roller 10 is located at the center CE1 of the cleaning roller 10 in the longitudinal direction D1 as illustrated in FIG. 13 as an example. In this case, there is a possibility that the cleaning roller 10 tilts in a direction in which the second end portion 22 side descends when an end portion of a medium (ME0) at the second end portion 22 side in the longitudinal direction D1 of the cleaning roller 10 is disposed closer to the first end portion 21 of the rotary shaft 20 of the cleaning roller 10 than the center CE1. When the cleaning roller 10 tilts, this may result in a reduction in a performance of removing the foreign materials or occurrence of an unusual noise.

Figure 4:
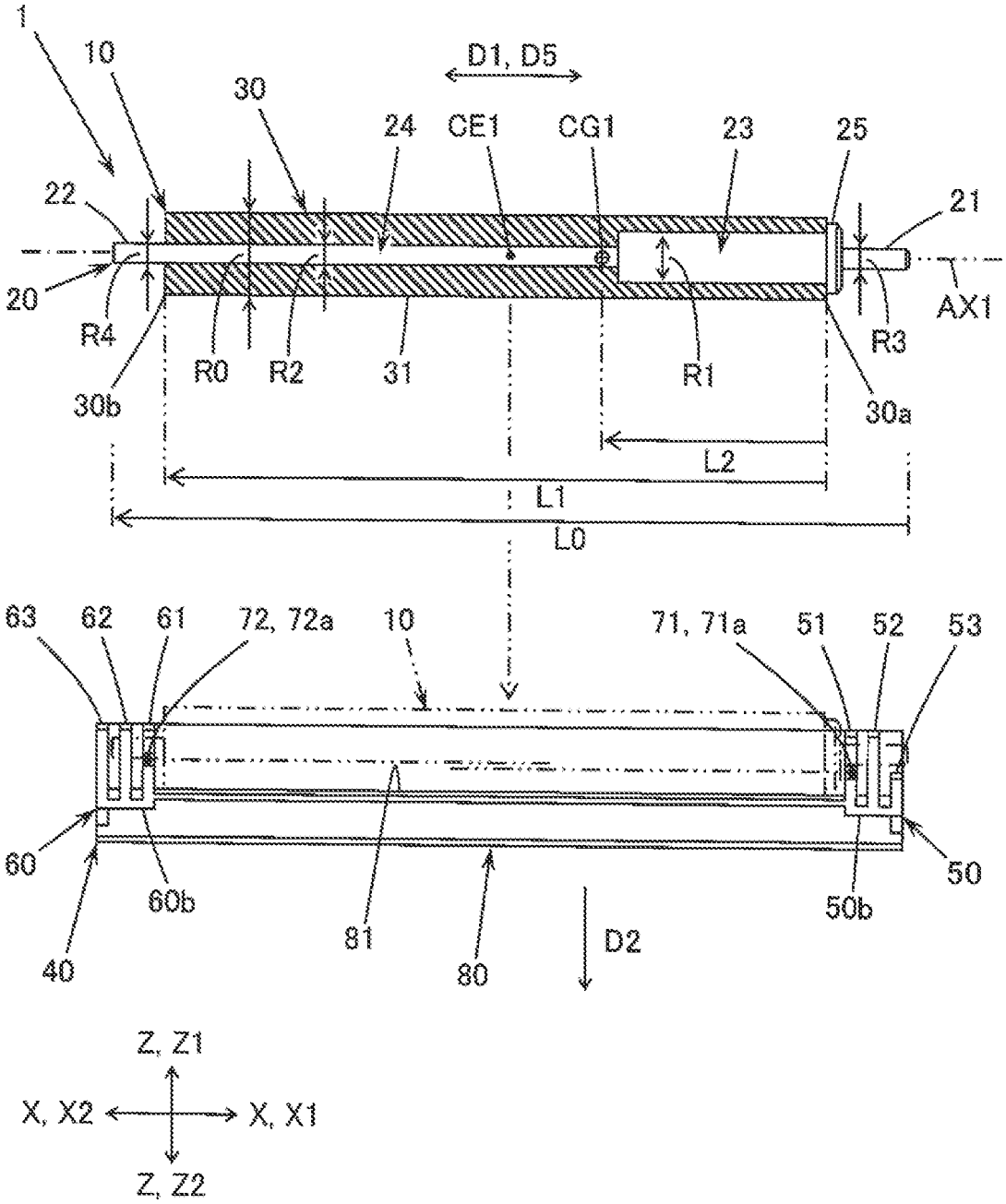
FIG. 4 is an exploded view schematically illustrating an example of a foreign material removing device.
Figure 10:
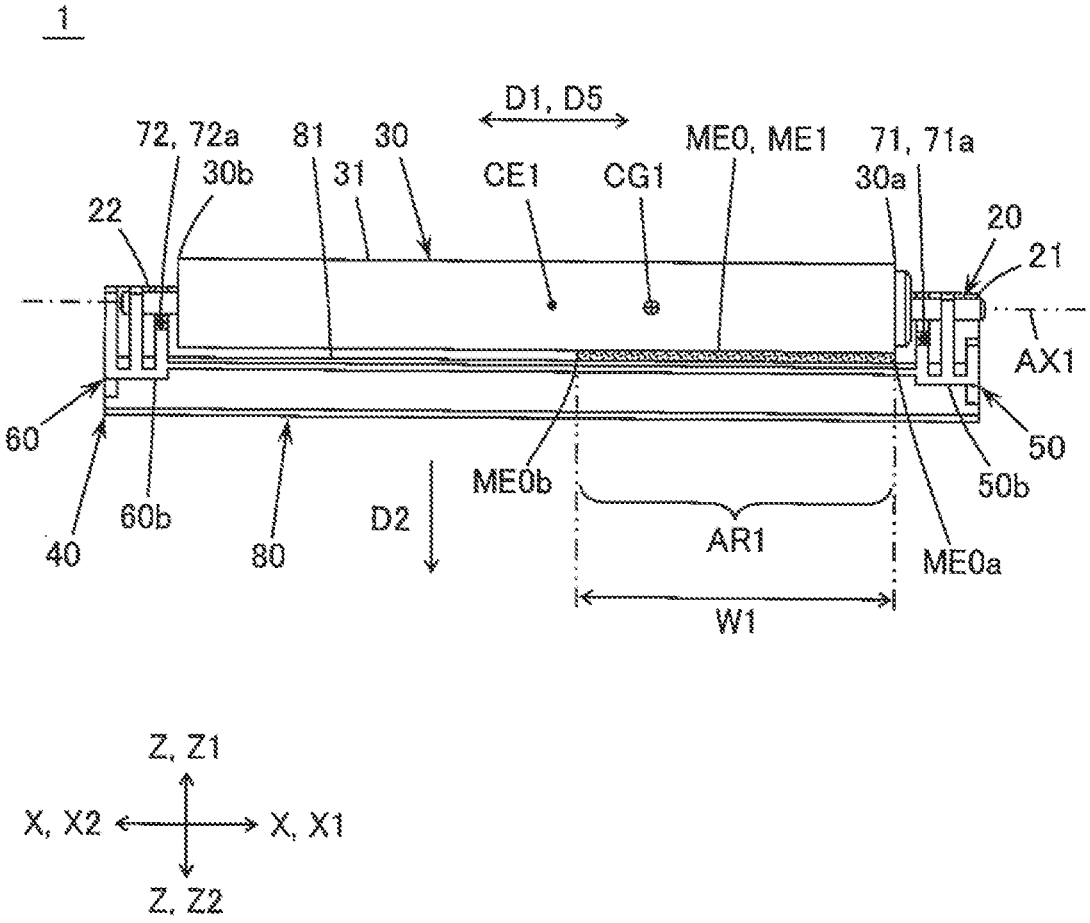
FIG. 10 is a diagram schematically illustrating an example in which a first recording medium having a relatively narrow width is passed through the foreign material removing device.

When the center of gravity CG1 of the cleaning roller 10 falls within a range of the first aspect as illustrated, for example, in FIGS. 4 and 10, the tilt of the cleaning roller 10 that is in contact with the medium (ME0) is suppressed even if the end portion of the medium (ME0) at the second end portion 22 side in the longitudinal direction D1 of the cleaning roller 10 is disposed closer to the first end portion 21 of the rotary shaft 20 of the cleaning roller 10 than the center CE1. Thus, the first aspect can provide a foreign material removing device that can suppress the tilt of the cleaning roller when the end portion of the medium located at the second end portion side of the rotary shaft of the cleaning roller in the longitudinal direction of the cleaning roller is disposed closer to the first end portion of the rotary shaft of the cleaning roller than the center of the cleaning roller.

Here, the recording medium includes roll paper, fanfold paper, or the like.

The terms "first," "second," . . . in the present application are terms used to identify individual constituent elements included in a plurality of constituent elements having similarity, and do not indicate the sequential order. Determination is made in a relative manner as to which of the plurality of constituent elements is denoted as the "first," "second," . . . .

Note that the above-described notes are also applied to the following aspects.

Second Aspect

As illustrated in FIG. 4 as an example, the rotary shaft 20 may include a first region 23 having a first diameter R1, and a second region 24 having a second diameter R2 smaller than the first diameter R1 and disposed closer to the second end portion 22 than the first region 23. A diameter of the sticky roller 30 at a position that overlaps with the first region 23 and a diameter of the sticky roller 30 at a position that overlaps with the second region 24 may be equal to each other. The rotary shaft 20 includes the first region 23 having the first diameter R1 and also includes the second diameter R2 smaller than the first diameter R1. In addition, the diameter R0 of the sticky roller 30 is equal between the position that overlaps with the first region 23 and the position that overlaps with the second region 24. Thus, the center of gravity CG1 of the cleaning roller 10 can be positioned at the first end portion 21 side relative to the center CE1 of the cleaning roller 10 in the longitudinal direction D1. In addition, the diameter of the cleaning roller 10 can be set to be constant, which makes it possible to obtain a favorable performance of removing the foreign materials. Thus, with the present aspect, it is possible to provide a favorable example in which the center of gravity of the cleaning roller is shifted toward the first end portion.

Third Aspect

Figure 12:
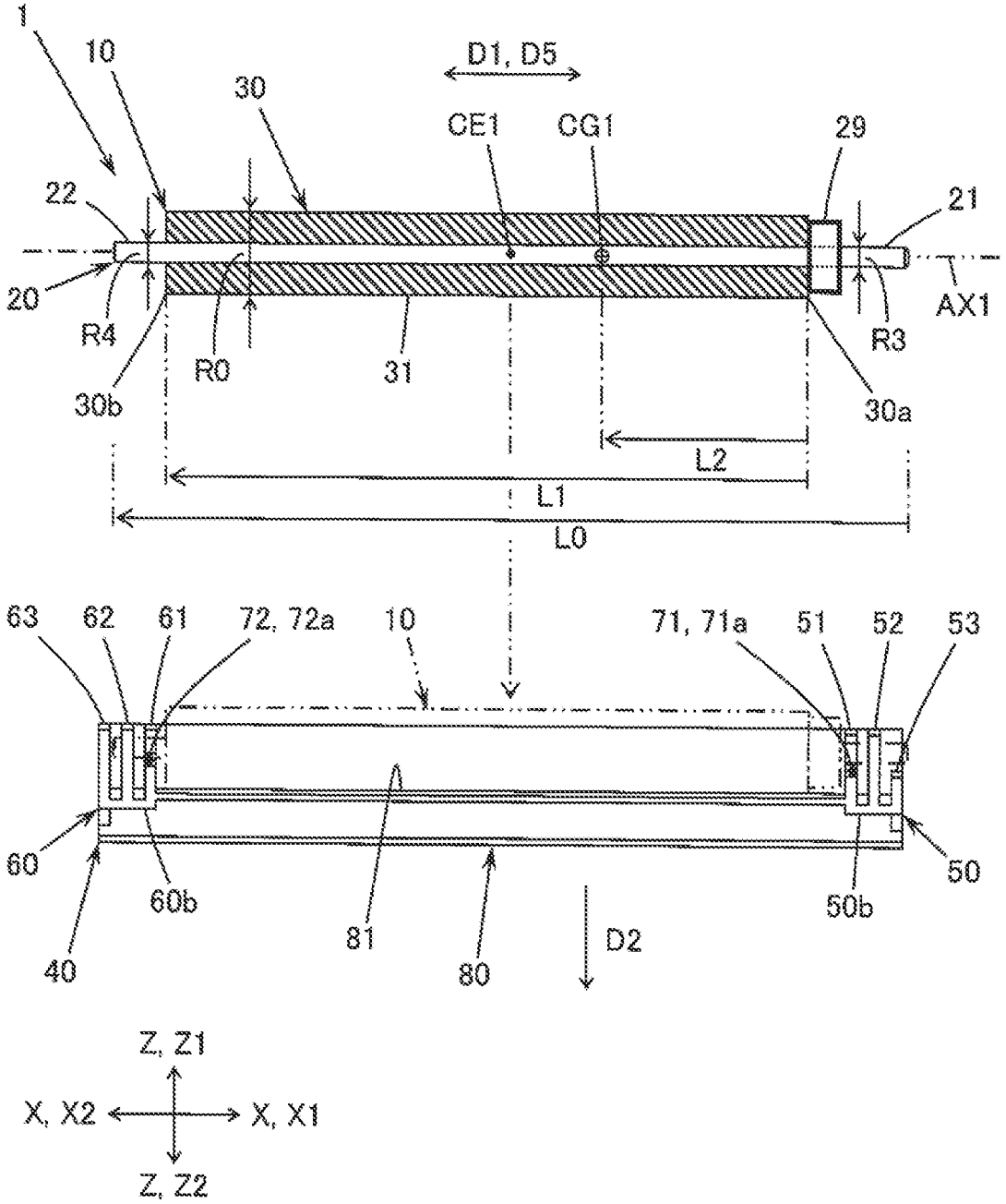
FIG. 12 is an exploded view schematically illustrating an example of a foreign material removing device including a weight attached to a rotary shaft.

As illustrated in FIG. 12 as an example, the cleaning roller 10 may include a weight 29 attached at a position of the rotary shaft 20 closer to the first end portion 21 than the sticky roller 30. With the present aspect, it is also possible to provide a favorable example in which the center of gravity of the cleaning roller is shifted toward the first end portion.

Fourth Aspect

Figure 5:
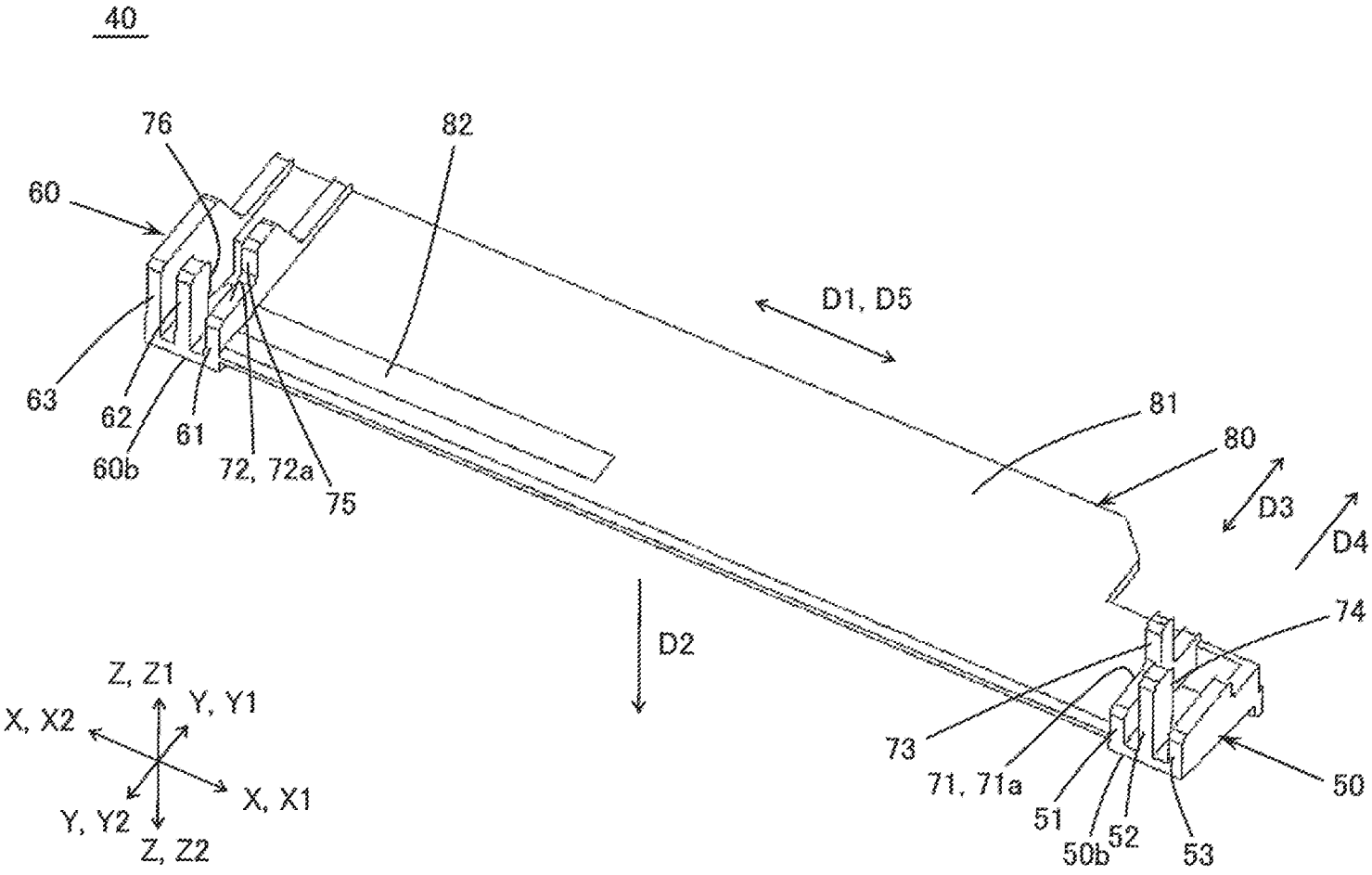
FIG. 5 is a perspective view schematically illustrating an example of a cleaning roller holder.
Figure 6:
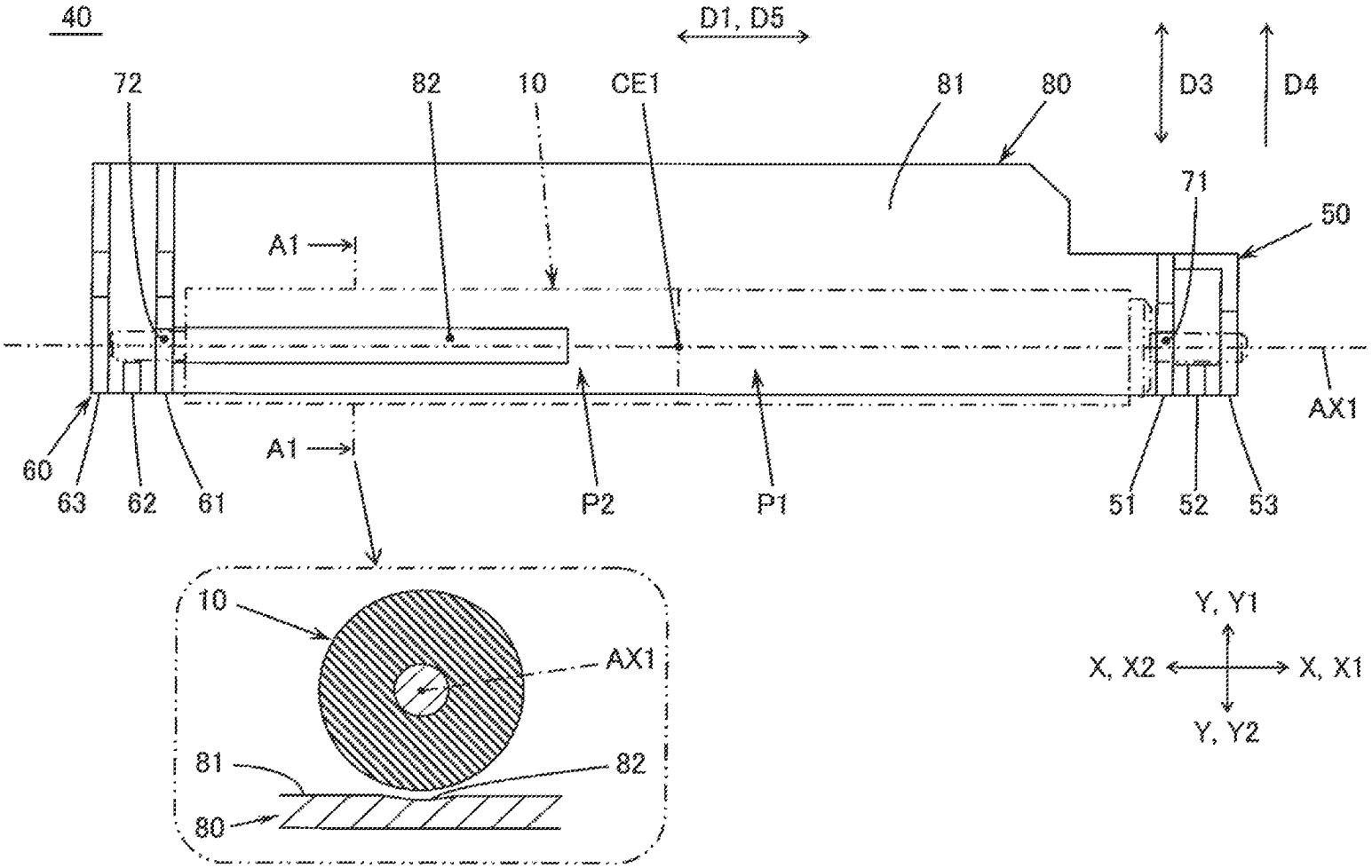
FIG. 6 is a plan view schematically illustrating an example of the cleaning roller holder.

As illustrated, for example, FIGS. 4 to 6 as examples, the first bearing portion 50 may include a first restricting portion 71 configured to restrict movement of the first end portion 21 in the gravitational direction D2. The second bearing portion 60 may include a second restricting portion 72 configured to restrict movement of the second end portion 22 in the gravitational direction D2. In the gravitational direction D2, an upper end 72*a* of the second restricting portion 72 may be disposed at a position higher than an upper end 71*a* of the first restricting portion 71. With this configuration, the second restricting portion 72, which is disposed relatively higher, restricts the tilt of the cleaning roller 10 in a direction in which the second end portion 22 side descends. Thus, with the present aspect, it is possible to provide a favorable example in which the tilt of the cleaning roller is suppressed.

Fifth Aspect

Figure 8:
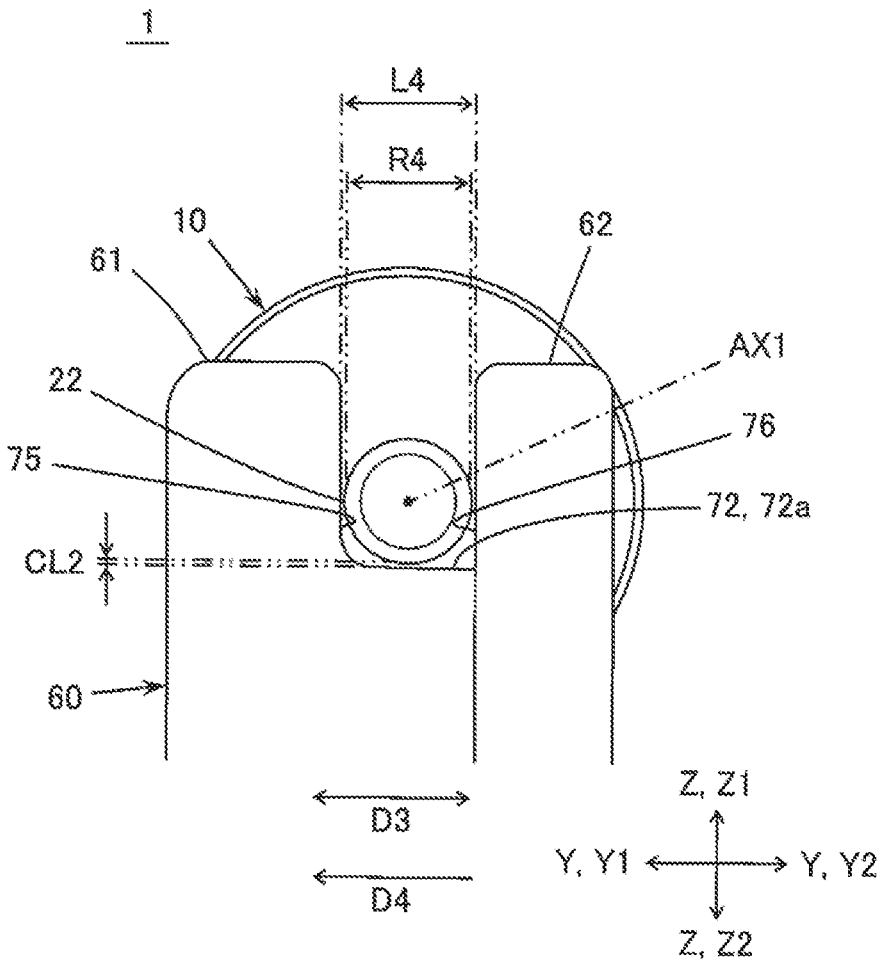
FIG. 8 is a right side view schematically illustrating an example of a gap between a second bearing portion and a second end portion.

As illustrated, for example, FIGS. 4 to 6 as examples, the cleaning roller holder 40 may include a bottom 80 configured to couple a lower portion 50*b* of the first bearing portion 50 and a lower portion 60*b* of the second bearing portion 60. As illustrated in FIG. 8 as an example, in a state where the first end portion 21 is disposed at the first bearing portion 50, the second end portion 22 is disposed at the second bearing portion 60, and the cleaning roller 10 is mounted at the bottom 80, a space CL2 in the gravitational direction D2 may exist between the second end portion 22 and the second restricting portion 72. With the present aspect, the cleaning roller 10 is sufficiently brought into contact with a medium (ME0), which makes it possible to provide a favorable structure for removing foreign materials.

Sixth Aspect

As illustrated in FIG. 6 as an example, the bottom 80 may have an upper surface 81 having a recess 82 that overlaps with a center line AX1 of the rotary shaft 20, the recess 82 being disposed in a portion P2 disposed at the second end portion 22 side relative to the center CE1 in the longitudinal direction D1, the portion P2 being located in a portion P1 that overlaps with the cleaning roller 10 in plan view. With the present aspect, the cleaning roller 10 is less likely to be brought into contact with the bottom 80 of the cleaning roller holder 40 when the cleaning roller 10 tilts in a direction in which the second end portion 22 side descends. Thus, it is possible to provide a favorable structure for suppressing occurrence of an unusual noise.

Seventh Aspect

Figure 7:
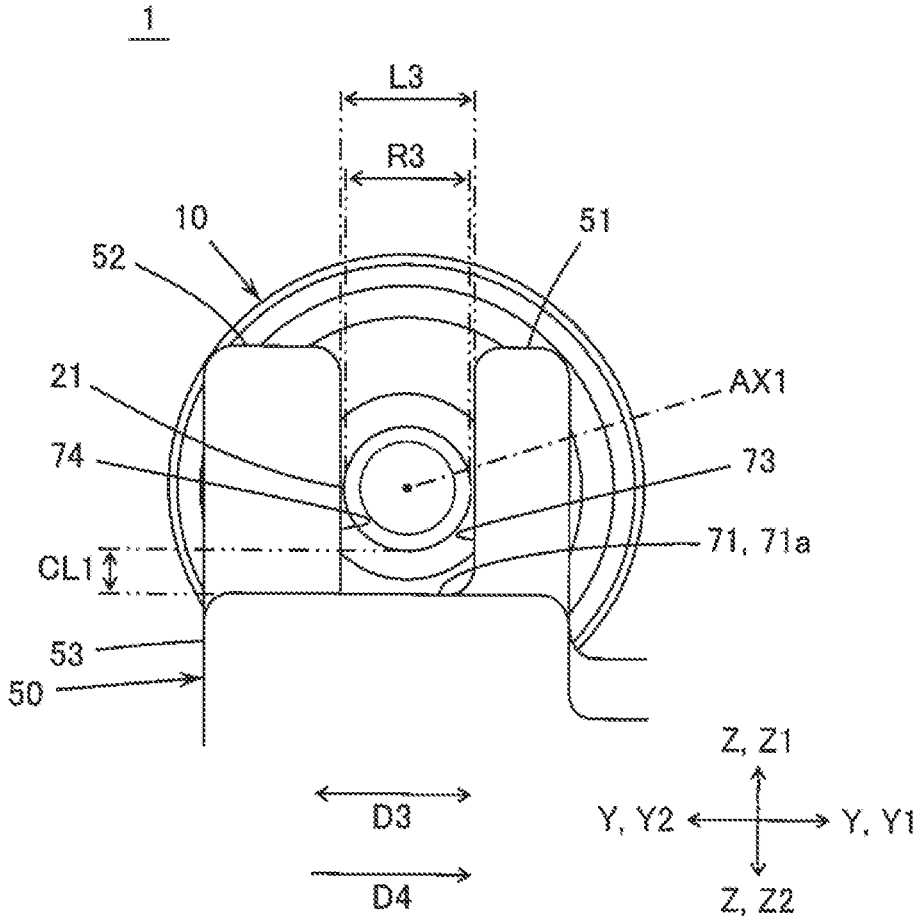
FIG. 7 is a left side view schematically illustrating an example of a gap between a first bearing portion and a first end portion.

As illustrated, for example, in FIG. 5 as an example, the first bearing portion 50 may include a third restricting portion 73 configured to restrict movement toward one side (for example, Y1 direction) in an intersecting direction D3 that intersects the gravitational direction D2 and the longitudinal direction D1 of the cleaning roller 10, and also include a fourth restricting portion 74 configured to restrict movement toward the other side (for example, Y2 direction) in the intersecting direction D3. The second bearing portion 60 may include a fifth restricting portion 75 configured to restrict movement toward the one side (Y1 direction) in the intersecting direction D3, and also include a sixth restricting portion 76 configured to restrict movement toward the other side (Y2 direction) in the intersecting direction D3. As illustrated in FIG. 7 as an example, a distance L3 between the third restricting portion 73 and the fourth restricting portion 74 may be larger than a diameter R3 of the first end portion 21. As illustrated in FIG. 8 as an example, a distance L4 between the fifth restricting portion 75 and the sixth restricting portion 76 may be larger than a diameter R4 of the second end portion 22. With the present aspect, it is possible to provide a favorable example in which the cleaning roller is positioned in a detachable manner.

Eighth Aspect

In addition, a printing apparatus 100 according to an aspect of the present technique includes a transport unit 110 configured to transport a recording medium ME0 in a transport direction D4, a guiding portion 120 configured to guide transport, by the transport unit 110, of the recording medium ME0, a printing head 130 configured to perform printing on the recording medium ME0, and the foreign material removing device 1 disposed upstream of the printing head 130 in the transport direction D4. The guiding portion 120 includes a first guide 121 configured to guide a one-side edge portion ME0a of the recording medium ME0 in a width direction D5 of a transport path C1 of the recording medium ME0, and a second guide 122 configured to guide an other-side edge portion ME0b of the recording medium ME0. The first guide 121 is unable to move in the width direction D5. The second guide 122 is able to move in the width direction D5. Here, this printing apparatus 100 is able to perform printing on a first recording medium ME1 and a second recording medium ME2 as the recording medium ME0. In addition, the second recording medium ME2 has a width in the width direction D5 wider than the first recording medium ME1. The first recording medium ME1 and the second recording medium ME2 are positioned in the width direction D5 with the first guide 121 being a reference. The foreign material removing device 1 includes the cleaning roller 10 to be brought into contact with the recording medium ME0 and a cleaning roller holder 40. The cleaning roller 10 includes the rotary shaft 20 including the first end portion 21 and the second end portion 22 disposed on an opposite side from the first end portion 21, and includes the sticky roller 30 attached to the rotary shaft 20 and having the front surface 31 having stickiness. The cleaning roller holder 40 includes the first bearing portion 50 configured to restrict a movement range of the disposed first end portion 21, and the second bearing portion 60 configured to restrict a movement range of the disposed second end portion 22. In a state where the first end portion 21 is disposed at the first bearing portion 50 and the second end portion 22 is disposed at the second bearing portion 60, the cleaning roller holder 40 positions the cleaning roller 10 in a detachable manner. The center of gravity CG1 of the cleaning roller 10 exists at a position that overlaps with the first recording medium ME1 in the width direction D5.

There is a case where the center of gravity CG1 of the cleaning roller 10 is located at the center CE1 of the cleaning roller 10 in the longitudinal direction D1. In this case, there is a possibility that the cleaning roller 10 tilts in a direction in which the second end portion 22 side descends when the first recording medium ME1 having a relatively narrow width is positioned in the width direction D5 with the first guide 121 being a reference. When the cleaning roller 10 tilts, this may result in a reduction in a performance of removing the foreign materials or occurrence of an unusual noise.

When the center of gravity CG1 of the cleaning roller 10 is located at a position that overlaps with the first recording medium ME1 in the width direction D5, the tilt of the cleaning roller 10 that is in contact with the medium ME1 is suppressed even if the first recording medium ME1 having a relatively narrow width is positioned in the width direction D5 with the first guide 121 being a reference. Thus, with the eighth aspect described above, it is possible to provide a printing apparatus that can suppress the tilt of the cleaning roller even if a recording medium having a relatively narrow width is positioned in the width direction with a one-side guide being a reference.

It should be noted that it is possible to add the second to seventh aspects described above to the eighth aspect described above.

In addition, the present technique can be applied to a method of removing a foreign material corresponding to the foreign material removing device described above, a printing method corresponding to the printing apparatus described above, or the like.

(2) SPECIFIC EXAMPLES OF A PRINTING APPARATUS THAT INCLUDES A FOREIGN MATERIAL REMOVING DEVICE

Figure 2:
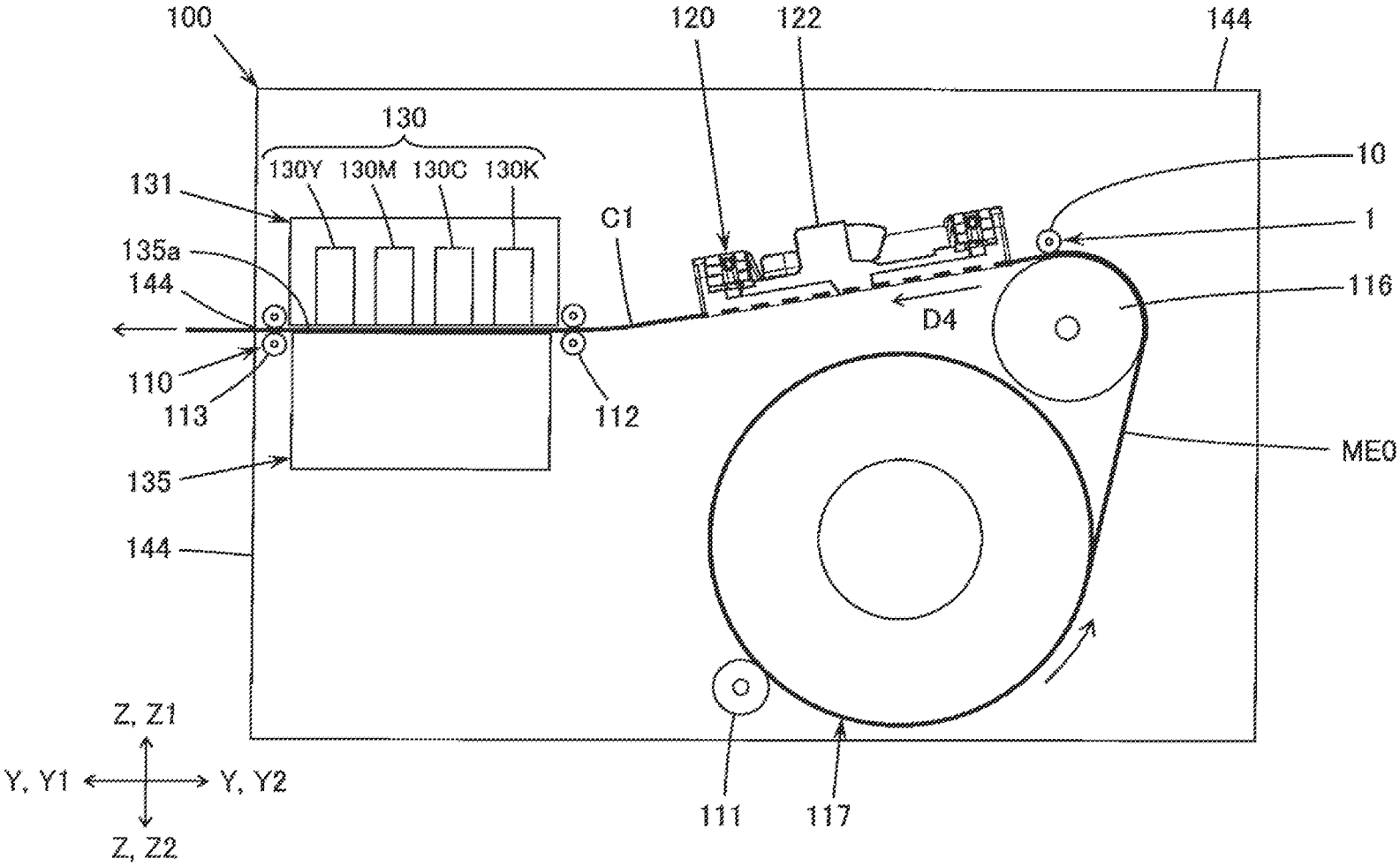
FIG. 2 is a diagram schematically illustrating an example of an interior of the printing apparatus.

FIG. 1 schematically illustrates, as an example, the printing apparatus 100 that includes the foreign material removing device 1. The printing apparatus 100 illustrated in FIG. 1 is in a state where a cover 141 provided at an upper portion of a transport path is opened and a cover 142 provided at a side of a roll paper accommodating portion is opened. The upper section of FIG. 1 illustrates the main components disposed at or around the foreign material removing device 1 of the printing apparatus 100. FIG. 2 schematically illustrates, as an example, the inside of the printing apparatus 100. In FIGS. 1 and 2, the X1 direction indicates a left direction; the X2 direction indicates a right direction opposite to the X1 direction; the Y1 direction indicates a forward direction perpendicular to the X1 and X2 directions; the Y2 direction indicates a rear direction opposite to the Y1 direction; the Z1 direction indicates an upward direction perpendicular to the X1 and X2 directions and the Y1 and Y2 directions; and the Z2 direction indicates a downward direction opposite to the Z1 direction. Here, the X1 and X2 directions are collectively referred to as an X direction, the Y1 and Y2 directions are collectively referred to as a Y direction, and the Z1 and Z2 directions are collectively referred to as a Z direction.

The printing apparatus 100 illustrated in FIGS. 1 and 2 includes a housing 140 having a substantially cuboid shape elongated in the Y direction as a whole. In an upper portion of a front face 140*a* of the housing 140, an operation panel 143 is built in at the left side, and a paper exit 144 is built in at the right side. The printing apparatus 100 illustrated in FIGS. 1 and 2 is an inkjet printer that discharges ink droplets from a printing head 130 onto a long recording medium ME0, and is also a label printer that performs printing on a label serving as the recording medium ME0. The printing head 130 is supplied with an ink serving as a color material from an ink cartridge, which is not illustrated. The recording medium ME0 illustrated in FIGS. 1 and 2 is accommodated in a roll paper accommodating portion 117 as roll paper. The roll paper accommodated in the roll paper accommodating portion 117 is held with a flange 115. Within the housing 140, a head unit 131 including the printing head 130 is disposed in an upper portion on the front side, and a platen unit 135 is disposed in a lower portion on the front side. The printing head 130 includes a nozzle face that faces downward, and discharges ink droplets in the Z2 direction from a plurality of nozzles disposed in the nozzle face. The platen unit 135 includes a horizontal platen surface 135*a* that is opposed to the nozzle face of the printing head 130 with a certain platen gap being provided therebetween.

The printing apparatus 100 includes, for example, the transport unit 110, the guiding portion 120, the printing head 130, and the foreign material removing device 1. The transport unit 110 transports the recording medium ME0 toward the transport direction D4. The guiding portion 120 guides the transport, by the transport unit 110, of the recording medium ME0. The printing head 130 performs printing on the recording medium ME0. The foreign material removing device 1 is disposed upstream of the printing head 130 in the transport direction D4 and at a position that overlaps with the transport path C1 in plan view. The foreign material removing device 1 is configured to remove foreign materials such as paper dust that exists on the front surface of the recording medium ME0. Here, the "disposed upstream" means being disposed at an opposite side from the transport direction D4 with the printing head 130 being a reference. The foreign material removing device 1 may be sold as a retrofit unit, and be built in the printing apparatus 100.

The transport path C1 starts from the roll paper accommodating portion 117. Then, the path passes through the tension lever 116, the foreign material removing device 1, the guiding portion 120, paired paper feed rollers 112, the platen surface 135*a*, and paired sheet ejecting rollers 113, and reaches the paper exit 144. The transport unit 110 includes, for example, a medium supply motor 111, the paired paper feed rollers 112, and the paired sheet ejecting rollers 113. The medium supply motor 111 drives so that the roll paper accommodated in the roll paper accommodating portion 117 rotates in a direction in which the roll paper is sent off. The tension lever 116 has a rotatable outer peripheral surface that is brought into contact with the recording medium ME0, and includes a spring used to apply force in the Y2 direction. With this configuration, the tension lever 116 gives tension to the recording medium ME0 disposed in the transport path C1. The guiding portion 120 sets the position, in the X direction, of the recording medium ME0 that has passed from the tension lever 116 through the foreign material removing device 1. The paired paper feed rollers 112 sandwich the recording medium ME0 that has passed through the guiding portion 120, and in this state, deliver the recording medium ME0 toward the platen surface 135*a*. The paired sheet ejecting rollers 113 sandwich the recording medium ME0 that has passed above the platen surface 135*a*, and in this state, deliver the recording medium ME0 toward the paper exit 144.

The head unit 131 illustrated in FIG. 2 is an assembly of line-type inkjet heads, and includes a printing head 130K for black, a printing head 130C for cyan, a printing head 130M for magenta, and a printing head 130Y for yellow. The printing heads 130K, 130C, 130M, and 130Y are collectively referred to as the printing head 130. The printing heads 130K, 130C, 130M, and 130Y each have an elongated shape in the X direction, and are arrayed in the Y direction at certain gaps. The nozzle face of the printing head 130 includes a plurality of nozzles configured to discharge ink droplets and arranged in the X direction over the length including the maximum width of the recording medium ME0. The printing head 130 discharges ink droplets from the plurality of nozzles to the recording medium ME0 on the platen surface 135*a*. The ink droplets landed on the recording medium ME0 create dots, and an image with a plurality of the dots is printed on the recording medium ME0.

Figure 3:
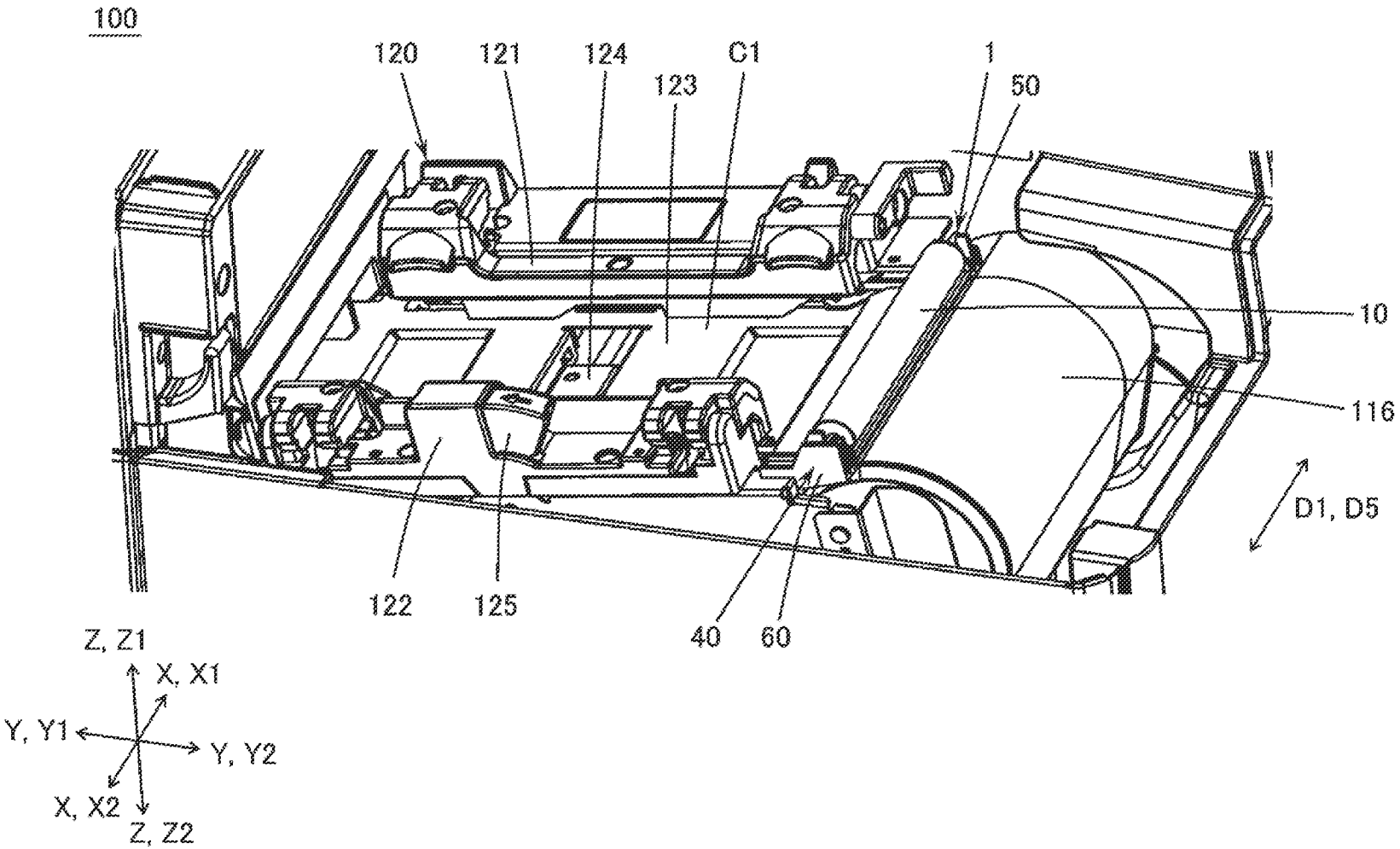
FIG. 3 is a perspective view schematically illustrating an example of a guiding portion and its surroundings of the printing apparatus.

FIG. 3 schematically illustrates, as an example, the guiding portion 120 of the printing apparatus 100 and its surroundings.

Figure 9:
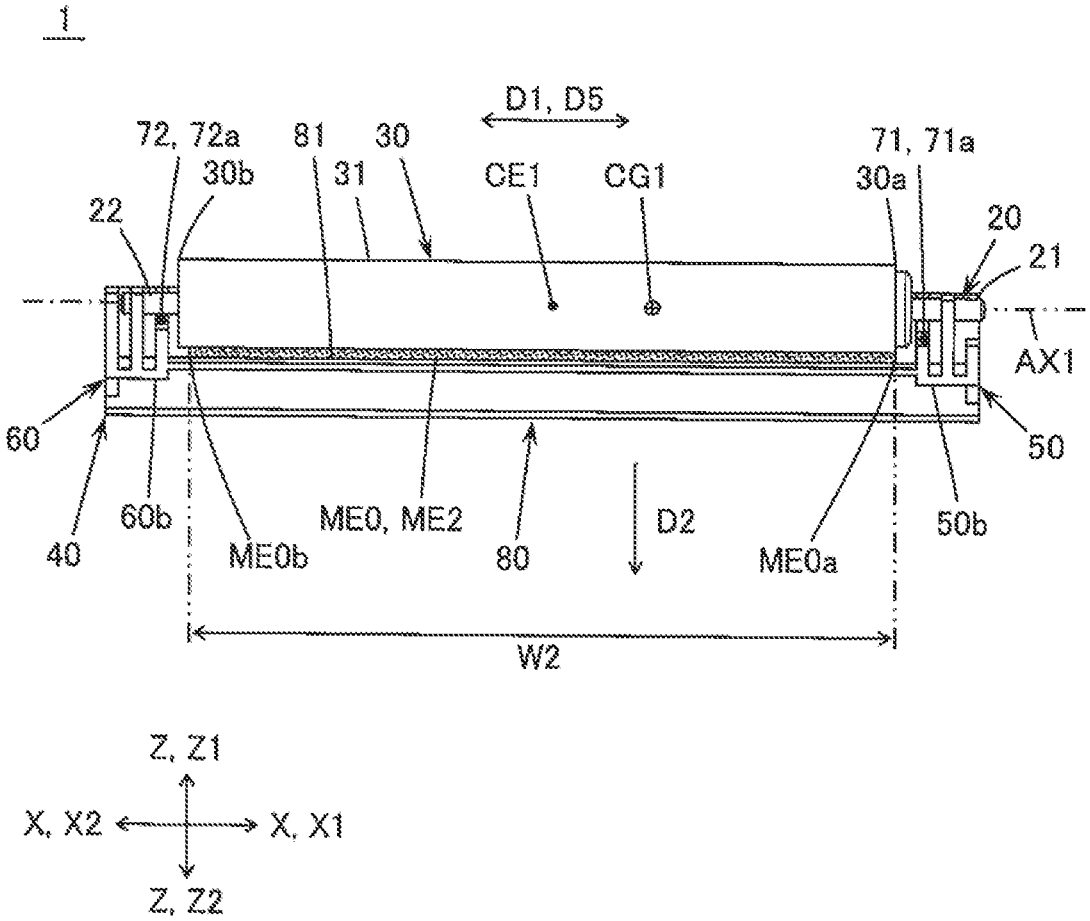
FIG. 9 is a diagram schematically illustrating an example in which a second recording medium having a relatively wide width is passed through the foreign material removing device.

The guiding portion 120 includes a base portion 123 on which the recording medium ME0 is mounted, a first guide 121 that sticks out in the Z1 direction from a right edge portion of the base portion 123, and a second guide 122 that sticks out in the X2 direction from this first guide 121. The base portion 123 is secured within the housing 140. The first guide 121 is not able to move in the width direction D5 of the transport path C1 of the recording medium ME0, and guides the one-side edge portion ME0a of the recording medium ME0. The second guide 122 includes a slide mechanism 124 that causes the second guide 122 to slide in the X direction relative to the base portion 123, and a lock release lever 125 used to release the lock against the slide of the second guide 122. The second guide 122 is able to move in the width direction D5. The width direction D5 is the X direction. By performing operation to press the lock release lever 125 in the arrowed direction to release the lock against the slide of the second guide 122, a user can cause the second guide 122 to slide in the X direction by hand. Once the user moves its hand off the lock release lever 125, the lock release lever 125 locks the slide of the second guide 122. In this state, the second guide 122 guides the other-side edge portion ME0b of the recording medium ME0. Thus, when the second recording medium ME2 having a relatively wide width W2 is used as the recording medium ME0 as illustrated in FIG. 9 as an example, the user is only necessary to perform operation of moving the second guide 122 to the right side so that the gap between the guides 121 and 122 matches the width W2. In addition, when the first recording medium ME1 having a relatively narrow width W1 is used as the recording medium ME0 as illustrated in FIG. 10 as an example, the user is only necessary to perform operation of moving the second guide 122 to the left side so that the gap between the guides 121 and 122 matches the width W1.

In this manner, the first recording medium ME1 and the second recording medium ME2 are positioned in the width direction D5 with the first guide 121 being a reference.

When the recording medium ME0 is the second recording medium ME2 having a relatively wide width, the printing apparatus 100 uses the first guide 121 as a reference to discharge ink droplets from the printing head 130 in keeping with the width W2 of the second recording medium ME2, thereby performing printing on the second recording medium ME2. When the recording medium ME0 is the first recording medium ME1 having a relatively narrow width, the printing apparatus 100 uses the first guide 121 as a reference to discharge ink droplets from the printing head 130 in keeping with the width W1 of the first recording medium ME1, thereby performing printing on the first recording medium ME1.

As illustrated in FIGS. 1 and 3, the foreign material removing device 1 disposed between the tension lever 116 and the guiding portion 120 in the transport path C1 includes the cleaning roller 10 that is brought into contact with the recording medium ME0, and the cleaning roller holder 40. The longitudinal direction D1 of the cleaning roller 10 is the X direction. The rotary shaft of the cleaning roller 10 includes the first end portion 21 that protrudes toward the X1 direction and the second end portion 22 that protrudes toward the X2 direction. The cleaning roller holder 40 includes the first bearing portion 50 that receives the first end portion 21, and the second bearing portion 60 that receives the second end portion 22, and is configured to position the cleaning roller 10 in a detachable manner. The cleaning roller 10 that has been positioned by the cleaning roller holder 40 is held with its own weight in a manner rotatable relative to the bearing portions 50, 60, and is brought into contact with the front surface of the recording medium ME0, thereby removing foreign materials from the front surface of the recording medium ME0.

FIG. 4 is an exploded view schematically illustrating an example of the foreign material removing device 1. In FIG. 4, a longitudinal cross section of the sticky roller 30 of the cleaning roller 10 is illustrated. In the cleaning roller holder 40 illustrated in FIG. 4, the position of the cleaning roller 10 when no recording medium ME0 exists is illustrated with a long dashed double-short dashed line. FIG. 5 is a perspective view schematically illustrating an example of the cleaning roller holder 40. FIG. 6 is a plan view schematically illustrating an example of the cleaning roller holder 40. In the cleaning roller holder 40 illustrated in FIG. 6, the position of the cleaning roller 10 when no recording medium ME0 exists is illustrated with a long dashed double-short dashed line. In addition, the vertical end surface obtained by cutting the foreign material removing device 1 along the position of A1-A1 is illustrated within a portion surrounded by a long dashed double-short dashed line. FIG. 7 schematically illustrates an example of the main components of the left side surface of the foreign material removing device 1, and also schematically illustrates an example of the space CL1 between the first bearing portion 50 of the cleaning roller holder 40 and the first end portion 21 of the cleaning roller 10. FIG. 8 schematically illustrates an example of the main components of the right side surface of the foreign material removing device 1, and also schematically illustrates an example of the space CL2 between the second bearing portion 60 of the cleaning roller holder 40 and the second end portion 22 of the cleaning roller 10. FIG. 9 schematically illustrates an example of a state where the second recording medium ME2 having a relatively wide width W2 is passed through the foreign material removing device 1. FIG. 10 schematically illustrates a state where the first recording medium ME1 having a relatively narrow width W1 is passed through the foreign material removing device 1.

The foreign material removing device 1 includes the cleaning roller 10 that is brought into contact with the recording medium ME0, and the cleaning roller holder 40. A user is able to install the cleaning roller 10 into the cleaning roller holder 40 from above the cleaning roller holder 40 as illustrated in FIGS. 1 and 4, and also is able to detach the cleaning roller 10 upward from the cleaning roller holder 40.

The cleaning roller 10 includes the rotary shaft 20 and the sticky roller 30. The sticky roller 30 has a tubular shape of which wall thickness changes in the middle, and has a through-hole through which the rotary shaft 20 is passed along the center line AX1 of the cleaning roller 10. The rotary shaft 20 that has passed through the sticky roller 30 includes the first end portion 21 that protrudes from a large diameter portion 25 of the rotary shaft 20 toward the X1 direction, and the second end portion 22 that protrudes from the sticky roller 30 toward the X2 direction. For a material of the rotary shaft 20, it is possible to use brass having a specific gravity that falls in a range of 8 to 9, or stainless steel having a specific gravity that falls in a range of 7 to 8, or other metals. The sticky roller 30 has a front surface 31 having stickiness, and is attached on the outer surface of the rotary shaft 20. For a material of the sticky roller 30, it is possible to use ethylene-propylene-diene methylene linkage (EPDM) rubber having a specific gravity less than 1, silicon rubber having a specific gravity less than 1, or other rubber material. The specific gravity of the rotary shaft 20 is greater than the specific gravity of the sticky roller 30.

The cleaning roller holder 40 includes the first bearing portion 50, the second bearing portion 60, and the bottom 80 configured to couple the lower portion 50*b* of the first bearing portion 50 and the lower portion 60*b* of the second bearing portion 60.

As illustrated in FIG. 7, the first bearing portion 50 includes the restricting portions 71, 73, and 74 configured to restrict movement of the first end portion 21 when the first end portion 21 is brought into contact. The first restricting portion 71 restricts movement, in the Z2 direction, of the first end portion 21 when the first end portion 21 is brought into contact. The third restricting portion 73 restricts movement, in the Y1 direction serving as the transport direction D4, of the first end portion 21 when the first end portion 21 is brought into contact. The fourth restricting portion 74 restricts movement, in the Y2 direction, of the first end portion 21 when the first end portion 21 is brought into contact. Here, the Y direction is an example of the intersecting direction D3 that intersects the gravitational direction D2 serving as the Z2 direction and the longitudinal direction D1 of the cleaning roller 10. When the cleaning roller 10 does not tilt, there is a space between the first restricting portion 71 and the first end portion 21. The distance L3 between the third restricting portion 73 and the fourth restricting portion 74 is larger than the diameter R3 of the first end portion 21. Thus, the first bearing portion 50 restricts a movement range of the disposed first end portion 21. The upper portion of the first bearing portion 50 is opened so that the first end portion 21 can pass through.

As illustrated in FIG. 8, the second bearing portion 60 includes the restricting portions 72, 75, and 76 configured to restrict movement of the second end portion 22 when the second end portion 22 is brought into contact. The second restricting portion 72 restricts movement, in the Z2 direction, of the second end portion 22 when the second end portion 22 is brought into contact. The fifth restricting portion 75 restricts movement, in the Y1 direction, of the second end portion 22 when the second end portion 22 is brought into contact. The sixth restricting portion 76 restricts movement, in the Y2 direction, of the second end portion 22 when the second end portion 22 is brought into contact. When the cleaning roller 10 does not tilt, there is a space between the second restricting portion 72 and the second end portion 22. The distance L4 between the fifth restricting portion 75 and the sixth restricting portion 76 is larger than the diameter R4 of the second end portion 22. Thus, the second bearing portion 60 restricts a movement range of the disposed second end portion 22. The upper portion of the second bearing portion 60 is opened so that the second end portion 22 can pass through.

In this manner, the cleaning roller holder 40 positions the cleaning roller 10 in a detachable manner in a state where the first end portion 21 is disposed at the first bearing portion 50 and the second end portion 22 is disposed at the second bearing portion 60. The cleaning roller 10 positioned by the cleaning roller holder 40 is brought into contact with the front surface of the recording medium ME0 with its own weight, and in association with transport of the recording medium ME0, rotates with the rotary shaft 20 being the center. Since the front surface 31 of the sticky roller 30, which is brought into contact with the front surface of the recording medium ME0, has stickiness, the cleaning roller 10 causes a foreign material that exists on the front surface of the recording medium ME0 to be attached on the sticky roller 30, thereby removing the foreign material.

There is no particular limitation as to the material of the cleaning roller holder 40, and it is possible to use synthetic resin, metal, or the like.

The one-side edge portion ME0a of the recording medium ME0 positioned with the first guide 121 of the guiding portion 120 illustrated in FIGS. 1 to 3 being a reference is aligned with the end portion 30*a* at one side of the sticky roller 30 as illustrated in FIGS. 9 and 10. The recording medium ME0 does not exist between the other-side edge portion ME0b of the recording medium ME0 and the end portion 30*b* at the other side of the sticky roller 30. The recording medium ME0 includes the first recording medium ME1 having a width W1 extending from the one-side edge portion ME0a of the sticky roller 30 and not reaching the center CE1 of the cleaning roller 10 in the longitudinal direction D1, as illustrated in FIG. 10. The center CE1 of the cleaning roller 10 means the middle position of the entire length L0 of the cleaning roller 10 as illustrated in FIG. 4. For example, the printing apparatus 100 is configured such that the width W2 of the second recording medium ME2 illustrated in FIG. 9 is set to 112 mm, and the width W1 of the first recording medium ME1 illustrated in FIG. 10 is set to 50 mm, thereby being able to perform printing on the recording medium ME0 having a width that falls in a range of W1 to W2. In this case, the width W1 of the first recording medium ME1 is approximately 45% of the width W2 of the second recording medium ME2, and is less than half of the width W2. The present specific example has a feature in which the center of gravity CG1 of the cleaning roller 10 is disposed at a position that overlaps with the first recording medium ME1 in the width direction D5 of the transport path C1.

FIG. 13 is a diagram schematically illustrating a foreign material removing device 901 according to a comparative example in which the center of gravity CG1 of a cleaning roller 910 is located at the center CE1 of the cleaning roller 910 in the longitudinal direction D1. Note that, of the plurality of elements included in the foreign material removing device 901, the elements that are substantially the same as the elements included in the foreign material removing device 1 illustrated in FIG. 10 are denoted with the reference characters illustrated in FIG. 10, and detailed explanation thereof will not be repeated.

The cleaning roller 910 includes a rotary shaft 920 having a diameter unchanged from the first end portion 21 to the second end portion 22, and a sticky roller 930 attached to the rotary shaft 920 and having the front surface 31 having stickiness. A cleaning roller holder 940 includes a first bearing portion 950 that receives the first end portion 21 in a detachable manner, a second bearing portion 960 that receives the second end portion 22 in a detachable manner, and the bottom 80 that couples the lower portion 50*b* of the first bearing portion 950 and the lower portion 60*b* of the second bearing portion 960.

The center of gravity CG1 of the cleaning roller 910 positioned by the cleaning roller holder 940 is located at the center CE1 of the cleaning roller 910 in the longitudinal direction D1, and is located outside of the first recording medium ME1 having a relatively narrow width W1. Thus, the cleaning roller 910 may tilt in a direction in which the second end portion 22 descends as illustrated in FIG. 13, which results in the edge portion 30*b* of the sticky roller 930 being brought into contact with the upper surface of the bottom 80. This leads to occurrence of an usual noise or occurrence of vibration. When this vibration is transferred to the head unit or platen unit, this reduces the quality of printing. In particular, when the first recording medium ME1 is sent off from the roll paper, the cleaning roller 910 is more likely to oscillate due to the first recording medium ME1 having a curly shape resulting from the shape of the roll. Thus, the cleaning roller 910 is more likely to tilt in a direction in which the second end portion 22 descends. When fanfold paper is used instead of roll paper, the cleaning roller 910 is more likely to oscillate due to the mountain-fold shape and the valley-fold shape resulting from the crease of the fanfold paper. Thus, the cleaning roller 910 is more likely to tilt in a direction in which the second end portion 22 descends.

Note that it can be consider to prepare a cleaning roller for every width of the recording medium ME0. However, this may lead to a disadvantage in that a cleaning roller needs to be selected for each width of the recording medium ME0, which is inconvenient, or the number of cleaning rollers increases, which results in an increase in the cost as well as the size of a packaging box, or the like.

In the present specific example, as illustrated in FIG. 10, a region where the first recording medium ME1 having a width W1 exists in the width direction D5 in the transport part C1 is set as a center-of-gravity disposed region AR1. In addition, the center of gravity CG1 of the cleaning roller 10 is set to be disposed at a position that overlaps with the first recording medium ME1 in the width direction D5. This suppresses the tilt of the cleaning roller 10 that is brought into contact with the first recording medium ME1 having a relatively narrow width W1.

In the rotary shaft 20 of the cleaning roller 10 illustrated in FIG. 4, the diameter R3 of the first end portion 21 and the diameter R4 of the second end portion 22 are equal to each other. The rotary shaft 20 having end portions 21 and 22 includes the first region 23 having the first diameter R1 larger than each of the diameters R3 and R4 of the end portions 21 and 22, and also includes the second region 24 having the second diameter R2 equal to each of the diameters R3 and R4 of the end portions 21 and 22 and disposed closer to the second end portion 22 than the first region 23. The second diameter R2 of the second region 24 is smaller than the first diameter R1 of the first region 23. On the other hand, a diameter of the sticky roller 30 at a position that overlaps with the first region 23 and a diameter of the sticky roller 30 at a position that overlaps with the second region 24 are equal to each other, and are the diameter R0. In addition, the rotary shaft 20 has a specific gravity greater than the sticky roller 30. Thus, the center of gravity CG1 of the cleaning roller 10 is shifted from the center CE1 of the cleaning roller 10 in the longitudinal direction D1 toward the first end portion 21 within a range where the sticky roller 30 exists in the longitudinal direction D1 of the cleaning roller 10. With this configuration, the center of gravity CG1 of the cleaning roller 10 falls in the center-of-gravity disposed region AR1 that overlaps with the first recording medium ME1 in the width direction D5 in the transport path C1. The rotary shaft 20 includes the first region 23 having the first diameter R1 and includes the second diameter R2 smaller than the first diameter R1. In addition, the diameter R0 of the sticky roller 30 is equal between a position that overlaps with the first region 23 and a position that overlaps with the second region 24. With this configuration, the center of gravity CG1 of the cleaning roller 10 can be positioned at the first end portion 21 side relative to the center CE1 of the cleaning roller 10 in the longitudinal direction D1, and the diameter of the cleaning roller 10 can be set to be constant. Thus, it is possible to obtain a favorable performance of removing foreign materials.

The rotary shaft 20 illustrated in FIG. 4 includes the large diameter portion 25 having a diameter larger than the first diameter R1 and disposed between the end portion 30*a* at one side of the sticky roller 30 and the first end portion 21 having the diameter R3. This makes it possible to shift the center of gravity CG1 of the cleaning roller 10 further toward the second end portion 22.

Here, the L1 represents a length from the end portion 30*a* at one side of the sticky roller 30 to the end portion 30*b* at the other side, and the L2 represents a distance from the end portion 30*a* at one side of the sticky roller 30 to the center of gravity CG1 of the cleaning roller 10. It is preferable that a ratio L2/L1 of the length L2 relative to the length L1 is more than 0 and not more than 0.45. In order to increase the ratio L2/L1, it is only necessary, for example, to shorten the first region 23 of the cleaning roller 10 in the longitudinal direction D1. In order to decrease the ratio L2/L1, it is only necessary, for example, to lengthen the first region 23 of the cleaning roller 10 in the longitudinal direction D1.

The first bearing portion 50 of the cleaning roller holder 40 illustrated in FIGS. 4 to 7 includes an inside piece 51 that sticks out in the Z1 direction from the lower portion 50*b*, an intermediate piece 52 that sticks out in the Z1 direction from the lower portion 50*b*, and an outside piece 53 that sticks out in the Z1 direction from the lower portion 50*b*, in the order toward the X1 direction. There is a space between the inside piece 51 and the intermediate piece 52. There is a space between the intermediate piece 52 and the outside piece 53. The inside piece 51 and the outside piece 53 include the first restricting portion 71 configured to restrict movement of the first end portion 21 in the gravitational direction D2. The inside piece 51 includes the third restricting portion 73 configured to restrict movement of the first end portion 21 to the Y1 direction. The intermediate piece 52 includes the fourth restricting portion 74 configured to restrict movement of the first end portion 21 to the Y2 direction. The distance L3 between the restricting portions 73 and 74 is larger than the diameter R3 of the first end portion 21.

The second bearing portion 60 of the cleaning roller holder 40 illustrated in FIGS. 4 to 6 and 8 includes an inside piece 61 that sticks out in the Z1 direction from the lower portion 60*b*, an intermediate piece 62 that sticks out in the Z1 direction from the lower portion 60*b*, and an outside piece 63 that sticks out in the Z1 direction from the lower portion 60*b*, in the order toward the X2 direction. There is a space between the inside piece 61 and the intermediate piece 62. There is a space between the intermediate piece 62 and the outside piece 63. The inside piece 61 includes the second restricting portion 72 configured to restrict movement of the second end portion 22 in the gravitational direction D2, and the fifth restricting portion 75 configured to restrict movement of the second end portion 22 to the Y1 direction. The intermediate piece 62 includes the sixth restricting portion 76 configured to restrict movement of the second end portion 22 to the Y2 direction. The distance L4 between the restricting portions 75 and 76 is larger than the diameter R4 of the second end portion 22.

Figure 11:
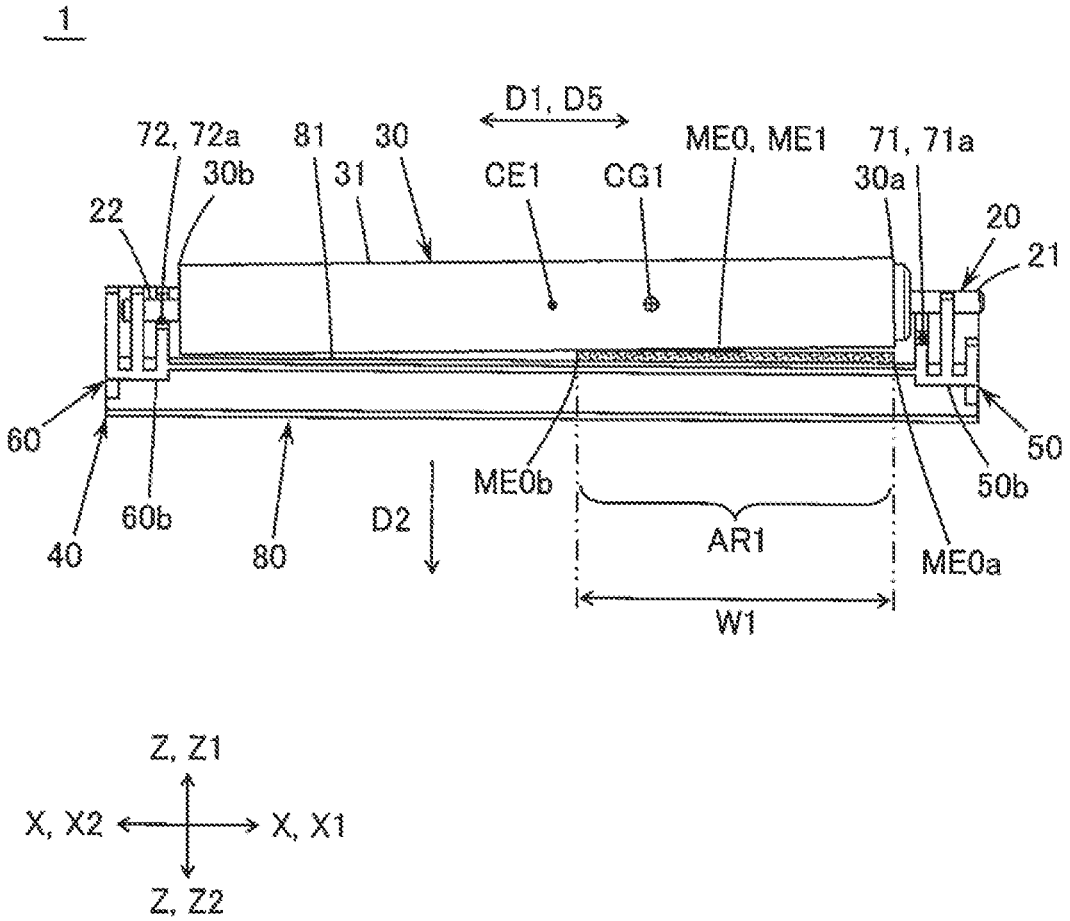
FIG. 11 is a diagram schematically illustrating an example of the foreign material removing device in a state where the second end portion is in contact with an upper end of a second restricting portion.

As illustrated in FIG. 4, the upper end 72*a* of the second restricting portion 72 is disposed at a position higher than the upper end 71*a* of the first restricting portion 71 in the gravitational direction D2. As illustrated in FIG. 10, even when the center of gravity CG1 of the cleaning roller 10 is disposed in the center-of-gravity disposed region AR1, the cleaning roller 10 may oscillate due to the first recording medium ME1 having a curly shape resulting from the shape of the roll. In this case, even when the cleaning roller 10 tends to tilt in a direction in which the first end portion 21 descends, the second end portion 22 is brought into contact with the upper end 72*a* of the second restricting portion 72 higher than the first restricting portion 71 as illustrated in FIG. 11 as an example. This suppresses the tilt of the cleaning roller 10 in a direction in which the second end portion 22 side descends, and the end portion 30*b* of the sticky roller 30 is not brought into contact with the upper surface 81 of the bottom 80. This suppresses occurrence of an unusual noise or vibration.

In the first bearing portion 50, the third restricting portion 73 configured to restrict movement of the first end portion 21 to the Y1 direction and the fourth restricting portion 74 configured to restrict movement of the first end portion 21 to the Y2 direction are disposed at different positions in the width direction D5 in the transport path C1, as illustrated in FIGS. 5 and 6. This configuration suppresses the deviation of the longitudinal direction D1 of the cleaning roller 10 from the width direction D5, which makes it possible to suppress skewing in which the recording medium ME0 deviates diagonally. In addition, in the second bearing portion 60, the fifth restricting portion 75 configured to restrict movement of the second end portion 22 to the Y1 direction and the sixth restricting portion 76 configured to restrict movement of the second end portion 22 to the Y2 direction are disposed at different positions in the width direction D5. This configuration suppresses the deviation of the longitudinal direction D1 of the cleaning roller 10 from the width direction D5, which makes it possible to suppress the skewing described above. Furthermore, the restricting portions 74 and 76 configured to restrict movement of the end portions 21, 22 to the Y2 direction are disposed at an outer side in the width direction D5 than the restricting portions 73 and 75 configured to restrict movement of the end portions 21, 22 to the Y1 direction, which makes it possible to effectively suppress the skewing described above. When the restricting portions 73 and 75 configured to restrict movement of the end portions 21 and 22 to the Y1 direction are disposed at an outer side in the width direction D5 than the restricting portions 74 and 76 configured to restrict movement of the end portions 21 and 22 to the Y2 direction, it is also possible to effectively suppress the skewing described above, although illustration thereof is not given.

As with the cleaning roller holder 40 illustrated in FIG. 4, it is assumed that the first end portion 21 is disposed at the first bearing portion 50, the second end portion 22 is disposed at the second bearing portion 60, and the cleaning roller 10 is mounted at the bottom 80. In this state, the space CL1 in the gravitational direction D2 exists between the first end portion 21 and the first restricting portion 71 as illustrated in FIG. 7. In addition, the space CL2 in the gravitational direction D2 exists between the second end portion 22 and the second restricting portion 72 as illustrated in FIG. 8. With this configuration, the cleaning roller 10 is sufficiently brought into contact with the recording medium ME0, which makes it possible to effectively remove the foreign materials that exist on the front surface of the recording medium ME0. Note that the upper end 72*a* of the second restricting portion 72 is higher than the upper end 71*a* of the first restricting portion 71. Thus, the space CL2 between the second end portion 22 and the second restricting portion 72 is smaller than the space CL1 between the first end portion 21 and the first restricting portion 71.

At the time of volume production of the foreign material removing devices 1, even if design is made such that the end portion 30*b* of the sticky roller 30 is not brought into contact with the upper surface 81 of the bottom 80 as illustrated in FIG. 11, it is conceived that variations of the foreign material removing device 1 occur. Thus, in order to make it less likely to be brought into contact with the bottom 80 when the cleaning roller 10 tilts in a direction in which the second end portion 22 side descends, the recess 82 is provided in the upper surface 81 of the bottom 80 as illustrated in FIGS. 5 and 6. The indentation 82 overlaps with the center line AX1 of the rotary shaft 20, and is disposed in the portion P2 of the portion P1 overlapping with the cleaning roller 10 in plan view of the upper surface 81 of the bottom 80. The portion P2 is disposed at the second end portion 22 side relative to the center CE1 in the longitudinal direction D1. With this configuration, when the cleaning roller 10 tilts in a direction in which the second end portion 22 side descends as illustrated in FIG. 11, it is less likely to be brought into contact with the bottom 80, which makes it possible to effectively suppress an unusual noise or vibration.

(3) OPERATION AND EFFECT OF FOREIGN MATERIAL REMOVING DEVICE ACCORDING TO SPECIFIC EXAMPLE

When the recording medium ME0 is the second recording medium ME2 having a relatively wide width W2 as illustrated in FIG. 9, the second recording medium ME2 exists over substantially the entire sticky roller 30 in the longitudinal direction D1 of the cleaning roller 10. Thus, it is less likely that the sticky roller 30 is brought into contact with the bottom 80 of the cleaning roller holder 40 due to the tilt of the cleaning roller 10. In association with transport of the second recording medium ME2, the cleaning roller 10 that comes into contact with the front surface of the second recording medium ME2 rotates with the rotary shaft 20 being the center, and causes a foreign material that exists on the front surface of the second recording medium ME2 to be attached on the sticky roller 30, thereby removing the foreign material.

When the recording medium ME0 is the first recording medium ME1 having a relatively narrow width W1 as illustrated in FIG. 10, the first recording medium ME1 does not exist over a wide area from the edge portion ME0b of the recording medium ME0 to the end portion 30*b* of the sticky roller 30. The center of gravity CG1 of the cleaning roller 10 described above is shifted further toward the first end portion 21 than the center CE1 of the cleaning roller 10 in the longitudinal direction D1, and is disposed at a position that overlaps with the first recording medium ME1 in the width direction D5 in the transport path C1. With this configuration, the first recording medium ME1 having a relatively narrow width W1 is positioned in the width direction D5 with the first guide 121 being a reference, and even if the first recording medium ME1 deviates toward the first end portion 21 of the cleaning roller 10, it is possible to suppress the tilt of the cleaning roller 10 in a direction in which the second end portion 22 side descends. In association with transport of the first recording medium ME1, the cleaning roller 10 that is brought into contact with the front surface of the first recording medium ME1 rotates with the rotary shaft 20 being the center, and causes a foreign material that exists on the front surface of the first recording medium ME1 to be attached on the sticky roller 30, thereby removing the foreign material.

In this manner, the printing apparatus 100 described above can suppress the tilt of the cleaning roller even when a recording medium having a relatively narrow width is positioned in the width direction with a guide at one side being a reference. The foreign material removing device 1 described above can suppress the tilt of the cleaning roller even when the center of a medium is shifted toward the first end portion of the rotary shaft of the cleaning roller in the longitudinal direction of the cleaning roller. Thus, it is possible to suppress an unusual noise or vibration due to the sticky roller 30 being brought into contact with the bottom 80 of the cleaning roller holder 40.

(4) MODIFICATION EXAMPLE

Various modification examples are conceivable for the present disclosure.

For example, the printing apparatus is not limited to a line-type inkjet printer. For example, the printing apparatus may be a serial-type inkjet printer that discharges ink droplets from a printing head while moving the printing head in a width direction in the transport path, or may be an electrophotographic printer such as a laser printer that uses a toner as a color material.

The type of color material that forms an image on the recording medium is not limited to a combination of black, cyan, magenta, and yellow. The color material includes, for example, light black having a lower degree of darkness than black, light cyan having a lower degree of darkness than cyan, light magenta having a lower degree of darkness than magenta, dark yellow having a higher degree of darkness than yellow, orange, green, and non-colored color material used to improve the quality of image. In addition, the present technique can be applied when a portion of the color materials of black, cyan, magenta, and yellow is not used.

As illustrated in FIG. 12 as an example, it is possible to attach the weight 29 to the rotary shaft 20 to shift the center of gravity CG1 of the cleaning roller 10 from the center CE1 toward the first end portion 21. FIG. 12 schematically illustrates an example of the foreign material removing device 1 including the weight 29 attached to the rotary shaft 20. Note that, of the plurality of elements illustrated in FIG. 12, the elements that are substantially the same as the elements illustrated in FIG. 4 are denoted with the reference characters illustrated in FIG. 4, and detailed explanation thereof will not be repeated. The rotary shaft 20 illustrated in FIG. 12 has a constant diameter R3=R4. The weight 29 is attached at a position of the rotary shaft 20 closer to the first end portion 21 than the end portion 30*a* of the sticky roller 30.

For a material of the weight 29, it is possible to use, for example, metal such as brass and stainless steel or other materials having a specific gravity greater than the sticky roller 30.

In this manner, the center of gravity CG1 of the cleaning roller 10 can be shifted toward the first end portion 21 relative to the center CE1, and can be disposed at a position that overlaps with the first recording medium ME1 in the width direction D5 in the transport path C1. Thus, the foreign material removing device 1 illustrated in FIG. 12 can also suppress the tilt of the cleaning roller even when the center of a medium is shifted toward the first end portion of the rotary shaft of the cleaning roller in the longitudinal direction of the cleaning roller.

Note that, when no recess 82 exists in the bottom 80 of the cleaning roller holder 40, it is possible to obtain the basic effect of suppressing the tilt of the cleaning roller, for example, even in a case where the upper end 72*a* of the second restricting portion 72 is not higher than the upper end 71*a* of the first restricting portion 71.

(5) CONCLUSION

As described above, with the present disclosure, through various aspects, it is possible to provide a technique such as a foreign material removing device that can suppress the tilt of the cleaning roller even when the center of a medium is shifted toward the first end portion of the rotary shaft of the cleaning roller in the longitudinal direction of the cleaning roller. Needless to say, the basic operation and effect described above can be obtained with a technique that is comprised only of the constituent elements set forth in the independent claims.

In addition, it is possible to implement, for example, a configuration obtained by replacing independent configurations disclosed in the examples described above with each other or modifying combinations of them, or a configuration obtained by replacing independent configurations disclosed in publicly available techniques and the examples described above with each other or modifying combinations of them. The present disclosure includes these configurations or the like.

What is claimed is:

1. A foreign material removing device comprising:

a cleaning roller to be brought into contact with a medium; and a cleaning roller holder, wherein the cleaning roller includes a rotary shaft including a first end portion and a second end portion disposed on an opposite side from the first end portion, and includes a sticky roller attached to the rotary shaft and having a front surface having stickiness, the cleaning roller holder includes a first bearing portion configured to restrict a movement range of the disposed first end portion, and a second bearing portion configured to restrict a movement range of the disposed second end portion, in a state where the first end portion is disposed at the first bearing portion and the second end portion is disposed at the second bearing portion, the cleaning roller holder positions the cleaning roller in a detachable manner, and a center of gravity of the cleaning roller is shifted from a center of the cleaning roller in a longitudinal direction toward the first end portion, and is in a range where the sticky roller exists in the longitudinal direction.

2. The foreign material removing device according to claim 1, wherein the rotary shaft includes:

a first region having a first diameter; and a second region having a second diameter smaller than the first diameter and disposed closer to the second end portion than the first region, and a diameter of the sticky roller at a position that overlaps with the first region and a diameter of the sticky roller at a position that overlaps with the second region are equal to each other.

3. The foreign material removing device according to claim 1, wherein the cleaning roller includes a weight attached at a position of the rotary shaft closer to the first end portion than the sticky roller.

4. The foreign material removing device according to claim 1, wherein the first bearing portion includes a first restricting portion configured to restrict movement of the first end portion in a gravitational direction, the second bearing portion includes a second restricting portion configured to restrict movement of the second end portion in the gravitational direction, and in the gravitational direction, an upper end of the second restricting portion is disposed at a position higher than an upper end of the first restricting portion.

5. The foreign material removing device according to claim 4, wherein the cleaning roller holder includes a bottom configured to couple a lower portion of the first bearing portion and a lower portion of the second bearing portion, and in a state where the first end portion is disposed at the first bearing portion, the second end portion is disposed at the second bearing portion, and the cleaning roller is mounted at the bottom, a space exists between the second end portion and the second restricting portion in the gravitational direction.

6. The foreign material removing device according to claim 5, wherein the bottom has an upper surface having a recess that overlaps with a center line of the rotary shaft, the recess being located in a portion, on a side of the second end portion relative to the center in the longitudinal direction, of a portion that overlaps with the cleaning roller in plan view.

7. The foreign material removing device according to claim 1, wherein the first bearing portion includes:

a third restricting portion configured to restrict movement toward one side in an intersecting direction that intersects a gravitational direction and the longitudinal direction of the cleaning roller; and a fourth restricting portion configured to restrict movement toward another side in the intersecting direction, the second bearing portion includes:

a fifth restricting portion configured to restrict movement toward the one side in the intersecting direction; and a sixth restricting portion configured to restrict movement toward the other side in the intersecting direction, a distance between the third restricting portion and the fourth restricting portion is larger than a diameter of the first end portion, and a distance between the fifth restricting portion and the sixth restricting portion is larger than a diameter of the second end portion.

8. A printing apparatus comprising:

a transport unit configured to transport a recording medium in a transport direction;

a guiding portion configured to guide transport, by the transport unit, of the recording medium;

a printing head configured to perform printing on the recording medium; and a foreign material removing device disposed upstream of the printing head in the transport direction, wherein the guiding portion includes a first guide configured to guide a one-side edge portion of the recording medium in a width direction of a transport path of the recording medium, and a second guide configured to guide an other-side edge portion of the recording medium, the first guide being configured not to move in the width direction, the second guide being configured to move in the width direction, the printing apparatus is configured to perform printing on a first recording medium and a second recording medium as the recording medium, the second recording medium having a width in the width direction wider than the first recording medium, the first recording medium and the second recording medium are positioned with the first guide being a reference in the width direction, the foreign material removing device includes a cleaning roller to be brought into contact with the recording medium, and includes a cleaning roller holder, the cleaning roller includes a rotary shaft including a first end portion and a second end portion disposed on an opposite side from the first end portion, and includes a sticky roller attached to the rotary shaft and having a front surface having stickiness, the cleaning roller holder includes a first bearing portion configured to restrict a movement range of the disposed first end portion, and a second bearing portion configured to restrict a movement range of the disposed second end portion, in a state where the first end portion is disposed at the first bearing portion and the second end portion is disposed at the second bearing portion, the cleaning roller holder positions the cleaning roller in a detachable manner, and a center of gravity of the cleaning roller exists at a position that overlaps with the first recording medium in the width direction.

9. The printing apparatus according to claim 8, wherein the rotary shaft includes:

a first region having a first diameter; and a second region having a second diameter smaller than the first diameter and disposed closer to the second end portion than the first region, and a diameter of the sticky roller at a position that overlaps with the first region and a diameter of the sticky roller at a position that overlaps with the second region are equal to each other.

10. The printing apparatus according to claim 8, wherein the cleaning roller includes a weight attached at a position of the rotary shaft closer to the first end portion than the sticky roller.

11. The printing apparatus according to claim 8, wherein the first bearing portion includes a first restricting portion configured to restrict movement of the first end portion in a gravitational direction, the second bearing portion includes a second restricting portion configured to restrict movement of the second end portion in the gravitational direction, and in the gravitational direction, an upper end of the second restricting portion is disposed at a position higher than an upper end of the first restricting portion.

12. The printing apparatus according to claim 11, wherein the cleaning roller holder includes a bottom configured to couple a lower portion of the first bearing portion and a lower portion of the second bearing portion, and in a state where the first end portion is disposed at the first bearing portion, the second end portion is disposed at the second bearing portion, and the cleaning roller is mounted at the bottom, a space exists between the second end portion and the second restricting portion in the gravitational direction.

13. The printing apparatus according to claim 12, wherein the bottom has an upper surface having a recess that overlaps with a center line of the rotary shaft, the recess being located in a portion, on a side of the second end portion relative to the center of the cleaning roller in the longitudinal direction, of a portion that overlaps with the cleaning roller in plan view.

14. The printing apparatus according to claim 8, wherein the first bearing portion includes:

a third restricting portion configured to restrict movement toward one side in an intersecting direction that intersects a gravitational direction and the width direction; and a fourth restricting portion configured to restrict movement toward another side, the second bearing portion includes:

a fifth restricting portion configured to restrict movement toward the one side in the intersecting direction; and a sixth restricting portion configured to restrict movement toward the other side in the intersecting direction, a distance between the third restricting portion and the fourth restricting portion is larger than a diameter of the first end portion, and a distance between the fifth restricting portion and the sixth restricting portion is larger than a diameter of the second end portion.

* * * * *